United States Patent [19]

Buchegger et al.

[11] Patent Number: 4,703,640

[45] Date of Patent: Nov. 3, 1987

[54] COILER-FURNACE UNIT

[75] Inventors: Rudolf Buchegger, St. Florian; Franz Hirschmanner, Leonding; Peter Heyer, Bad Vöslau, all of Austria

[73] Assignee: Voest-Alpine Aktiengesellschaft, Linz, Austria

[21] Appl. No.: 884,021

[22] Filed: Jul. 10, 1986

[30] Foreign Application Priority Data

Aug. 21, 1985 [AT] Austria ..... 2424/85

[51] Int. Cl.[4] ..... B21C 47/06

[52] U.S. Cl. ..... 72/128; 72/148; 72/202

[58] Field of Search ..... 72/128, 146, 148, 200, 72/202, 342; 432/10, 224

[56] References Cited

U.S. PATENT DOCUMENTS 1,918,968 7/1933 Kenney et al. ..... 72/148 X
3,119,606 1/1964 Suydam et al. ..... 72/200 X
4,407,486 10/1983 Mills et al. ..... 72/200 X
4,442,690 4/1984 Hirschmanner et al. ..... 72/128
4,485,651 12/1984 Tippins et al. ..... 72/148 X

FOREIGN PATENT DOCUMENTS 2123725 2/1984 United Kingdom ..... 72/202

*Primary Examiner*—E. Michael Combs
*Attorney, Agent, or Firm*—Kurt Kelman

[57] ABSTRACT

In a coiler-furnace unit comprising a coiler for coiling a metal strip, a sleeve (2), which comprises heating means (3) for heating the coiler mandrel (1) and is adapted to be axially displaced over the coiler mandrel (1), and a heat-insulating shell (7) associated with said sleeve, a uniform heating of the coiled strip and a low dissipation of heat are ensured in that the heat-insulating shell (7) is mounted to be axially displaceable toward the coiler mandrel (1) relative to the sleeve (2) and is provided with a passage slot (18) for receiving the metal strip.

8 Claims, 2 Drawing Figures

COILER-FURNACE UNIT

BACKGROUND OF THE INVENTION

1. Field of the Invention

This invention relates to a coiler-furnace unit comprising a coiler for coiling a metal strip, a sleeve, which comprises heating means for heating the coiler mandrel and is adapted to be axially displaced over the coiler mandrel, and a heat-insulating shell associated with said sleeve.

2. Description of the Prior Art

In order to ensure that strip will be economically preheated without a formation of additional scale, it is known from Austrian Patent Specification No. 373,290 to heat the coiled strip via the coiler mandrel rather than by means of hot gases fed into the coiler-furnace unit. For this purpose a sleeve is provided, which comprises means for heating the coiler mandrel and which is pushed over the coiler mandrel before the strip is coiled. By that sleeve the coiler mandrel is heated up so that the heat stored by the coiler mandrel can be transferred to the strip when the latter has been coiled. The sleeve is provided with a heat-insulating shell in order to ensure that a dissipation of radiant heat, e.g., to the strip-guiding means, which are movable into engagement with the coiler mandrel, will be avoided as the coiler mandrel is heated up. But in spite of that measure it is not possible to avoid a dissipation of radiant heat because the sleeve is removed from the coiler mandrel when the same has been heated up and a considerable heat quantity is then transferred to the coiled strip to the strip-guiding means.

SUMMARY OF THE INVENTION

For this reason it is an object of the invention to avoid that disadvantage and to provide simple means with which a coiler-furnace unit of the kind described first hereinbefore can be so improved that the coiled strip can be uniformly heated up from the coiler mandrel with a relatively low dissipation of heat.

The object set forth is accomplished in accordance with the invention in that the heat-insulating shell is mounted to be axially displaceable toward the coiler mandrel relative to the sleeve and is provided with a passage slot for receiving the metal strip.

Because the heat-insulating shell is displaceable relative to the sleeve, the heat-insulating shell can be used also without a sleeve. When the heat-insulating shell is introduced between the strip being coiled and the strip-guiding means when the same have been lifted from the coiler mandrel after the first convolutions of the strip have been formed, a transfer of heat from the coiled strip to the strip-guiding means by a conduction and radiation of heat will be effectively inhibited. Because in that position the adjacent ends of the sleeve and of the heat-insulating shell may adjoin, the coiled strip will be shielded also at its end so that the coiled strip will be uniformly heated up also in its marginal portions. The passage slot of the heat-insulating shell permits a simple feeding of the strip to the coiler mandrel. When the strip has been coiled and uncoiled, the heat-insulating shell is moved over the sleeve so that a dissipation of radiant heat from the coiler mandrel as it is heated up will be avoided.

In accordance with a further feature of the invention, a particularly simple design will be obtained if the heat-insulating shell is axially displaceable relative to the sleeve by means of a positioning drive, which is supported on the sleeve. In that case the sleeve and the heat-insulating shell can be adjusted in unison by a drive provided for that purpose and an operation of the positioning drive associated with the insulating shell is required only for a displacement of the heat-insulating shell relative to the sleeve.

To avoid a loading of the sleeve and its support by the weight of the heat-insulating shell, the heat-insulating shell and the sleeve may be mutually independently mounted on and slidable along respective axial tracks so that the structure will be relatively light in weight and the advantage will be afforded that the heat-insulating shell need not be mounted on the sleeve. A mounting of the heat-insulating shell on the sleeve would give rise to difficulties because the sleeve must not be provided with tracks that serve to guide the heat-insulating shell and protrude toward the coiler mandrel because in that case the sleeve could not be pushed over the coiler mandrel.

If the heat-insulating shell is adapted to be heated, the dissipation of heat from the metal strip can be kept particularly small because a transfer of heat from the strip to the heat-insulating shell can be inhibited. In that case the heat-insulating shell can be directly heated up or can be preheated from the outside.

DETAILED DESCRIPTION OF THE PREFERRED EMBODIMENT

Figure 1:
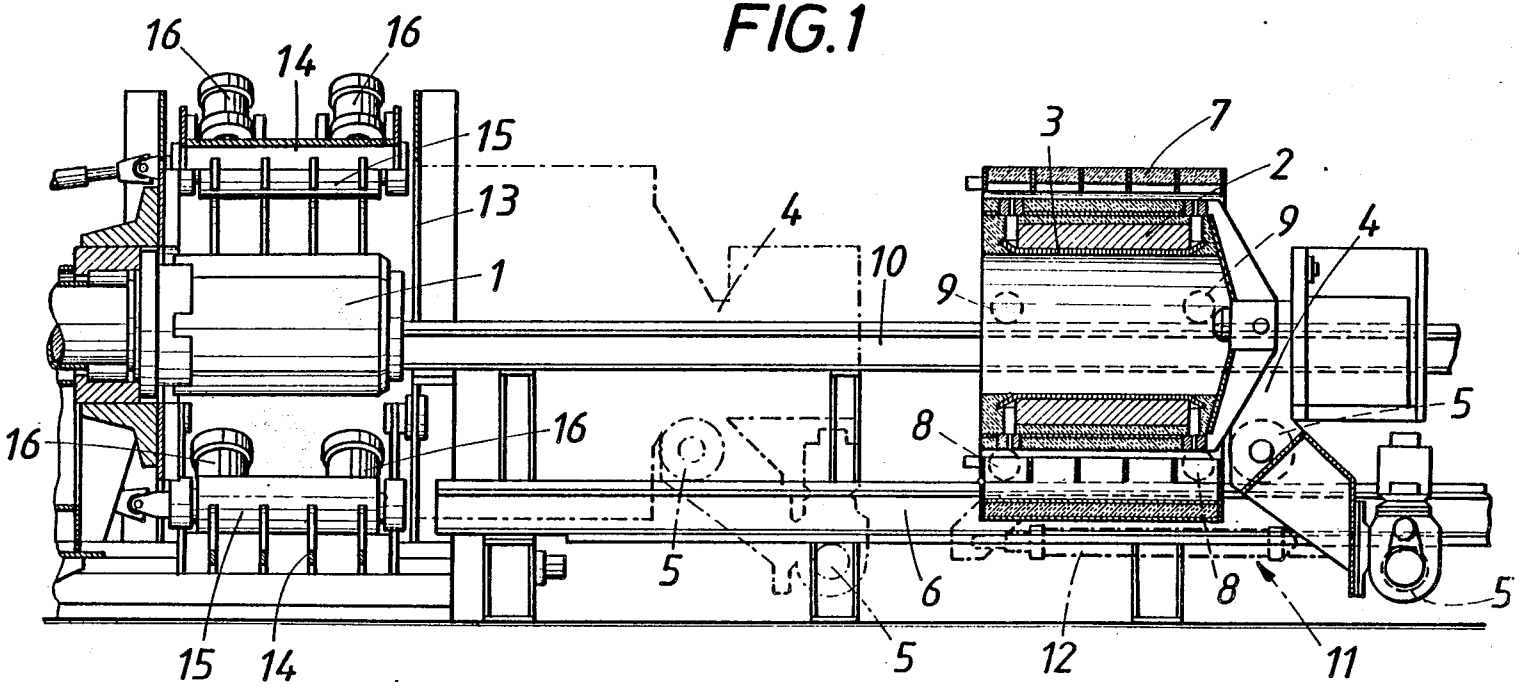
FIG. 1 is a diagrammatic axial sectional view showing a coiler-furnace unit embodying the invention.

An illustrative embodiment of the invention will now be described with reference to the drawing.

The illustrated coiler-furnace unit comprises essentially a coiler mandrel 1 and a sleeve 2, which is axially displaceable over the coiler mandrel 1 and is provided with electric heating means consisting of an induction coil 3 for heating the coiler mandrel 1 when the sleeve 2 has been pushed over the mandrel 1. The sleeve 2 is mounted on a car 4, which is supported by wheels 5 on an axial track 6 and is movable along the same and can be driven by means of a gearmotor.

A heat-insulating shell 7 is associated with the sleeve 2 and is supported by rollers 8 on the track 6 for the sleeve 2 and is supported by rollers 9 on a separate axial track 10 and is movable on said tracks 6 and 10 relative to the sleeve 2. For that purpose a positioning drive 11 is provided, which in the illustrative embodiment comprises a positioning cylinder 12, which is pivoted at one end to the car 4 for the sleeve 2 and at the other end to the heat-insulating shell 7.

Figure 2:
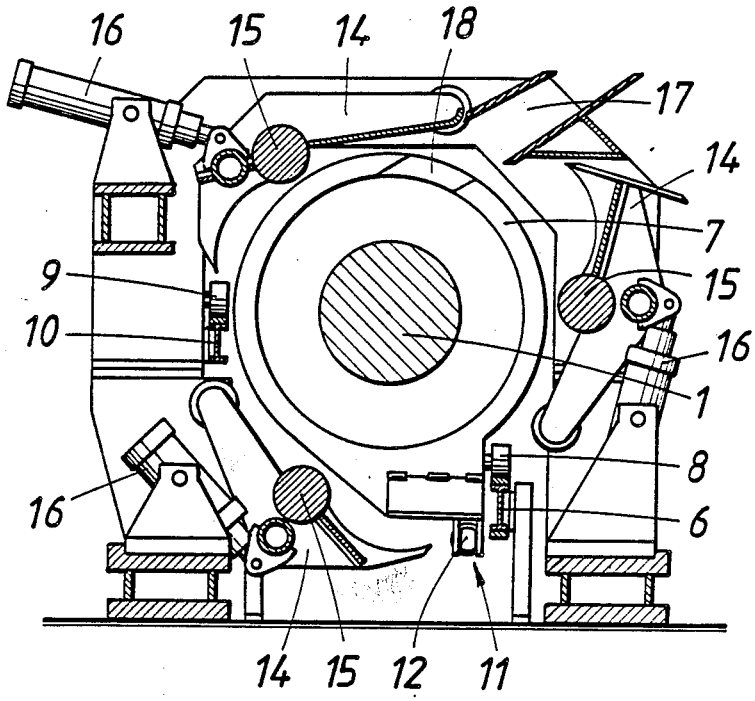
FIG. 2 is a simplified transverse sectional view showing that coiler-furnace unit.

When the sleeve 2 and the heat-insulating shell 7 are displaced in unison toward the coiler mandrel 1 from their initial position, shown in solid lines in FIG. 1, and the sleeve finally surrounds the coiler mandrel 1, the coiler mandrel 1 can then be heated up by the induction coil 3 and the stored heat can subsequently been transferred to a strip as it is coiled. For that purpose the sleeve 2 and the shell 7 are retracted to the position which is indicated in phantom in FIG. 1 and in which the shell 7 adjoins the entrance opening 13 formed in one end wall of the coiler of the coiler-furnace unit. Thereafter the strip-guiding means are moved into engagement with the coiler mandrel 1 so that the leading end of the strip can be coiled. Those strip-guiding means are constituted by two rockers 14, which are distributed around the circumference of the coiler mandrel 1 and carry pressure-applying rollers 15. The rockers 14 are operable by cylinders 16 to move the rollers 15 into engagement with the coiler mandrel 1 so that the leading end of strip which has entered the coiler of the coiler-furnace unit through a strip entrance passage 17 will be trained around the coiler mandrel 1. That initial coiling operation is terminated when e.g., three or four convolutions of the strip have been formed. Thereafter the coiler mandrel 1 is fully expanded and the strip-guiding means are lifted from the strip. For the continued coiling of the strip, the positioning drive 11 is operated to move the heat-insulating shell 7 into the coiler to extend between the pressure-applying rollers 15, which have been lifted, and the convolutions of the previously coiled strip. The strip is now fed to the coiler mandrel 1 through a passage slot 18 formed in the heat-insulating shell 7, as is apparent from FIG. 2. The passage slot 18 extends axially in the heat-insulating shell 7 and is open at that end which is the leading end as the heat-insulating shell 7 is pushed into the interior of the coiler so that the strip can then enter the slot 18. The rockers 14 and the pressure-applying rollers 15 are now shielded against a radiation of heat from the strip. The heat-insulating shell 7, the insulated end walls of the coiler-furnace unit and the slidable sleeve 2 adjoining the entrance opening 13 now define a substantially enclosed space so that the strip will be uniformly heated also in its marginal portions and a substantial dissipation of heat by radiation or conduction need not be feared. When the strip has been coiled the heat-insulating shell 7 remains in that axial position in which the shell 7 surrounds the coiler mandrel 1 until the strip has been completely uncoiled. The heat-insulating shell 7 is moved out of the coiler only for a short time to permit the pressure-applying rollers 15 to be moved into engagement with the coiler mandrel for the next succeeding initial coiling operation.

The strip can be heated under particularly desirable conditions if the heat-insulating shell 7 can be heated either by heating means incorporated in said shell or from the outside. In that case the temperature difference between the heated strip and the heat-insulating shell can be controlled so as to preclude a substantial dissipation of heat from the strip. The heat-insulating shell 7 is desirably provided with shell-heating means for heating the shell 7 independently of the heating means 3 of the sleeve 2 when the heat-insulating shell surrounds the coiler mandrel 1.

We claim:

1. In a coiler-furnace unit comprising a coiler mandrel for coiling a metal strip, a sleeve, which is coaxial to said coiler mandrel and has an inside diameter that exceeds the outside diameter of said coiler mandrel and which is axially displaceable relative to said coiler mandrel between a first position, in which said sleeve is axially spaced from said coiler mandrel, and a second position, in which said sleeve surrounds said coiler mandrel, said sleeve comprising heating means for heating said coiler mandrel when said sleeve is in said second position, and a heat-insulating shell, which is mounted to be axially displaceable relative to said coiler mandrel in unison with said sleeve as the latter moves between said first and second positions, the improvement residing in that said heat-insulating shell is mounted to be axially displaceable relative to said coiler mandrel and to said sleeve to and from a heat-insulating position, in which said heat-insulating shell surrounds said coiler mandrel when said sleeve is in said first position, and said heat-insulating shell is formed with a passage slot for receiving and directing the strip toward the coiler mandrel for subsequent coiling therearound when said shell is in said heat-insulating position.

2. The improvement set forth in claim 1, wherein said passage slot extends axially in said shell and opens in a direction toward a leading end of the strip when said shell is displaced in said heat-insulating position.

3. The improvement set forth in claim 1, wherein a positioning drive is provided, which is supported by said sleeve and operable to axially displace said heat-insulating shell relative to said coiler mandrel and to said sleeve to and from said heat-insulating position.

4. The improvement set forth in claim 1, wherein first and second axially extending tracks are provided and said slidable sleeve and said heat-insulating shell are mounted to be axially displaceable independently of each other on said first and second tracks, respectively.

5. The improvement set forth in claim 1, wherein heating means are provided for said heat-insulating shell.

6. The improvement set forth in claim 5, wherein shell-heating means are provided for heating said heat-insulating shell independently of said heating means of said sleeve when said heat-insulating shell is in said heat-insulating position.

7. The improvement set forth in claim 1, wherein shell-heating means are incorporated in said heat-insulating shell.

8. The improvement set forth in claim 1, wherein said sleeve and said heat-insulating shell have ends which adjoin each other when said sleeve is in said first position and said heat-insulating shell is in said heat-insulating position.

* * * * *